US008357078B2

(12) United States Patent
Taguchi

(10) Patent No.: US 8,357,078 B2
(45) Date of Patent: Jan. 22, 2013

(54) SHEET FOLDING APPARATUS, SHEET FINISHING APPARATUS HAVING THE SAME AND SHEET FOLDING METHOD

(75) Inventor: Hiroyuki Taguchi, Shizuoka-Ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 338 days.

(21) Appl. No.: 12/855,581

(22) Filed: Aug. 12, 2010

(65) Prior Publication Data

US 2011/0065563 A1 Mar. 17, 2011

Related U.S. Application Data

(60) Provisional application No. 61/242,714, filed on Sep. 15, 2009.

(51) Int. Cl.
*B31F 1/10* (2006.01)

(52) U.S. Cl. ..... 493/442; 493/411; 493/421; 493/440; 270/8

(58) Field of Classification Search ..... 493/405, 493/411, 413, 419, 420, 421, 440, 442, 448; 270/8, 39.06, 39.08
See application file for complete search history.

(56) References Cited

U.S. PATENT DOCUMENTS 5,076,556 A * 12/1991 Mandel ..... 270/45
5,769,774 A * 6/1998 Beck et al. ..... 493/421
7,052,005 B2 * 5/2006 Yamakawa et al. ..... 270/37
7,300,045 B2 11/2007 Terao et al.
7,648,136 B2 1/2010 Terao et al.
2007/0063411 A1 3/2007 Hirano
2009/0062100 A1 * 3/2009 Takekawa et al. ..... 493/454
2011/0103866 A1 * 5/2011 Imazu et al. ..... 400/578

FOREIGN PATENT DOCUMENTS

JP 2004196477 A 7/2004
JP 200541659 A 2/2005

* cited by examiner

*Primary Examiner* — Thanh Truong
(74) *Attorney, Agent, or Firm* — Patterson & Sheridan, LLP

(57) ABSTRACT

According to an embodiment, a sheet folding apparatus includes: a conveying roller pair configured to convey a sheet; a conveying path provided on a downstream side of the conveying roller pair, an opening being formed in a part of the conveying path if the sheet is triple-folded and being closed if the sheet is double-folded; a retracting conveying path, an inlet of which is opened to the opening of the conveying path and an outlet of which is closed by a stopper, the retracting conveying path leading the front end of the sheet, which is conveyed through the conveying path, from the inlet to the stopper and temporarily retracting the front of the sheet if the sheet is triple-folded; a first folding roller pair disposed near the inlet of the retracting conveying path, the first folding roller pair nipping, if the sheet is triple-folded, a bend caused by pushing of the sheet led by the conveying rollers into the retracting conveying path to form a first fold and nipping, if the sheet is double-folded, the front end of the sheet, which is conveyed through the closed conveying path, and conveying the sheet further downstream; and a second folding roller pair configured to further form a second fold in the sheet on which the first fold is formed to triple-fold the sheet, and form only the second fold in the sheet on which the first fold is not formed to double-fold the sheet.

20 Claims, 10 Drawing Sheets

SHEET FOLDING APPARATUS, SHEET FINISHING APPARATUS HAVING THE SAME AND SHEET FOLDING METHOD

CROSS-REFERENCE TO RELATED APPLICATIONS

This application is based upon and claims the benefit of priority from: U.S. provisional applications 61/242,714 filed on Sep. 15, 2009, the entire contents of which are incorporated herein by reference.

FIELD

Embodiments described herein relate generally to a sheet folding apparatus, a sheet finishing apparatus having the same, and a sheet folding method.

BACKGROUND

Conventionally, there are known sheet finishing apparatuses set on downstream sides of image forming apparatuses such as a copying machine, a printer, and a multi-functional peripheral (MFP) and configured to apply finishing such as folding and saddle stapling to printed sheets.

Among these sheet finishing apparatuses, some sheet finishing apparatuses perform not only saddle folding for folding sheets in the center but also triple folding such as so-called Z-folding, inward triple folding, and outward triple folding. However, the sheet finishing apparatus or a sheet folding apparatus in the past configured to perform the triple folding includes exclusive folding mechanisms such as a folding roller, a conveying path, and a conveying roller exclusively used for the triple folding.

Therefore, there is a demand for a sheet folding apparatus and a sheet finishing apparatus that can perform the saddle folding (double folding) and the triple folding with a simpler and more compact configuration.

DETAILED DESCRIPTION

Exemplary embodiments of a sheet folding apparatus, a sheet finishing apparatus having the same, and a sheet folding method are explained with reference to the accompanying drawings.

In general, according to an embodiment, a sheet folding apparatus includes: a conveying roller pair configured to convey a sheet; a conveying path provided on a downstream side of the conveying roller pair, an opening being formed in a part of the conveying path if the sheet is triple-folded and being closed if the sheet is double-folded; a retracting conveying path, an inlet of which is opened to the opening of the conveying path and an outlet of which is closed by a stopper, the retracting conveying path leading the front end of the sheet, which is conveyed through the conveying path, from the inlet to the stopper and temporarily retracting the front of the sheet if the sheet is triple-folded; a first folding roller pair disposed near the inlet of the retracting conveying path, the first folding roller pair nipping, if the sheet is triple-folded, a bend caused by pushing of the sheet led by the conveying rollers into the retracting conveying path to form a first fold and nipping, if the sheet is double-folded, the front end of the sheet, which is conveyed through the closed conveying path, and conveying the sheet further downstream; and a second folding roller pair configured to further form a second fold in the sheet on which the first fold is formed to triple-fold the sheet, and to form only the second fold in the sheet on which the first fold is not formed to double-fold the sheet.

(1) An Image Forming Apparatus and a Sheet Finishing Apparatus

Figure 1:
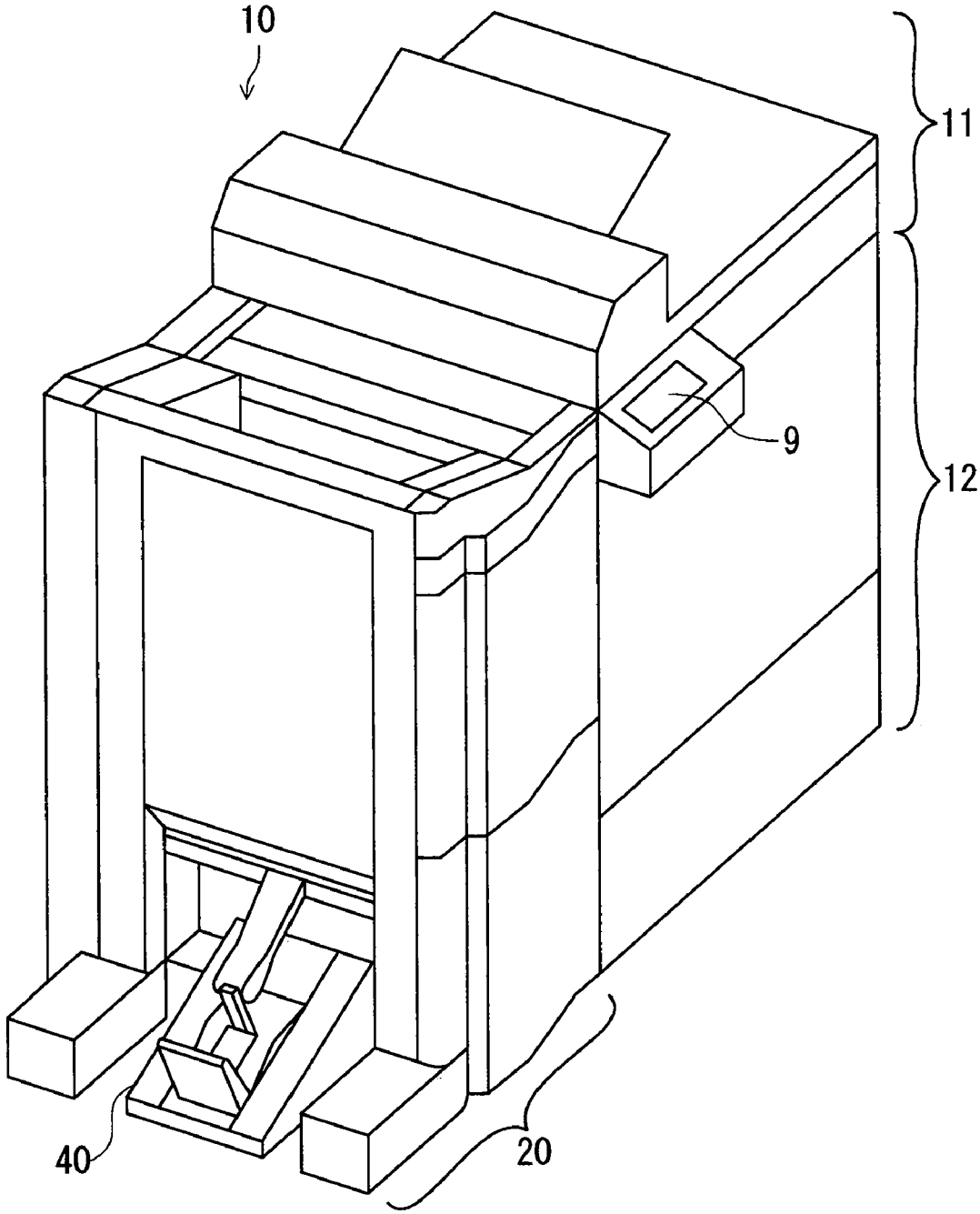
FIG. 1 is a perspective view of an external appearance example of an image forming apparatus including a sheet finishing apparatus of an embodiment.

FIG. 1 is an external perspective view of a basic configuration example of an image forming apparatus 10 including a sheet finishing apparatus 20 according to an embodiment. The image forming apparatus 10 includes a reading section 11 configured to read an original document, an image forming section 12 configured to print image data of the read original document on a sheet in an electrophotographic system, and a sheet finishing apparatus 20 configured to apply finishing such as sorting, punching, folding, or saddle stapling to printed sheets. The image forming section 12 includes an operation section 9 for a user to perform various kinds of operation.

Figure 2:
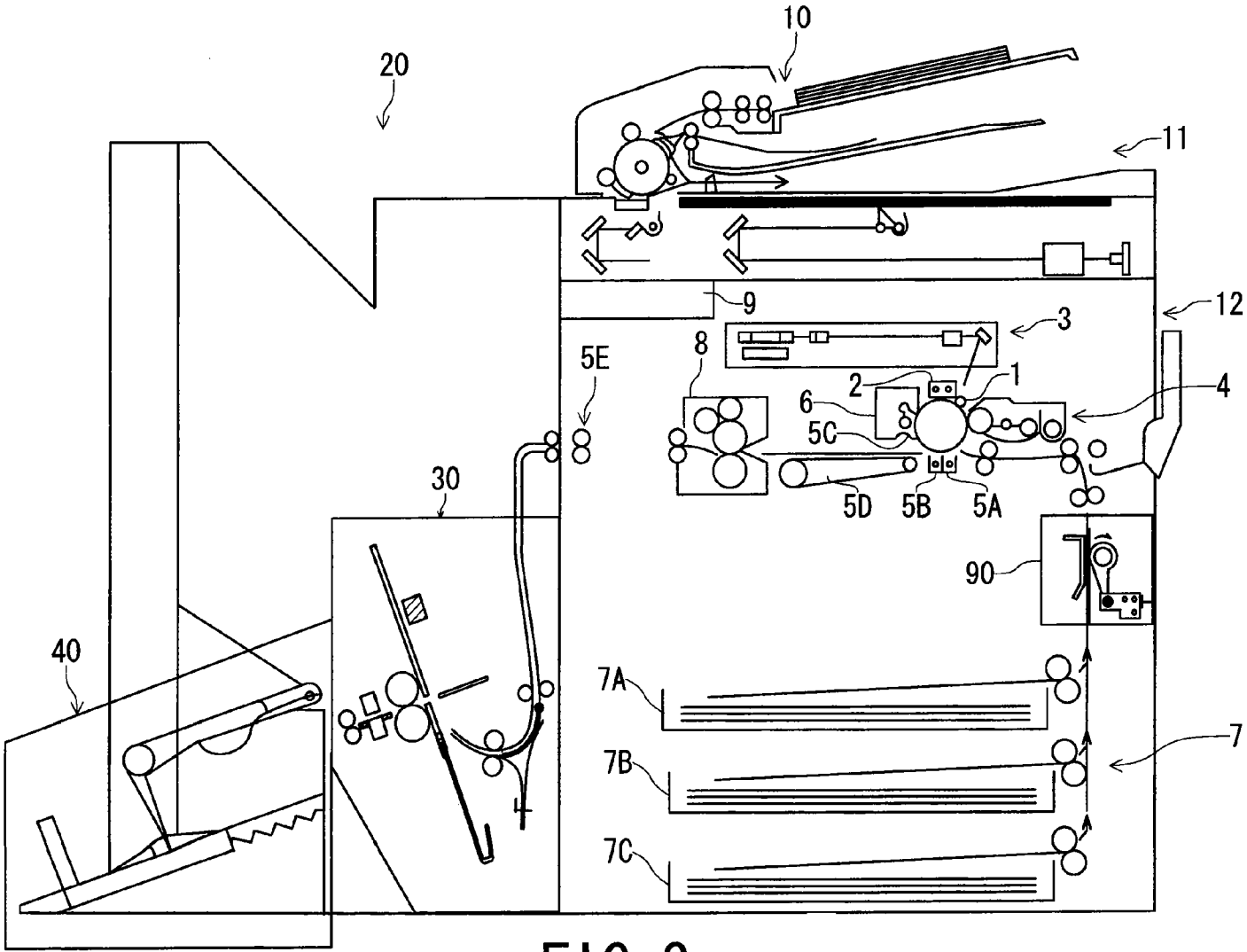
FIG. 2 is a sectional view of a configuration example of the image forming apparatus of the embodiment.

FIG. 2 is a sectional view of a configuration example of details of the image forming apparatus 10.

The image forming section 12 of the image forming apparatus 10 includes a photoconductive drum 1 in the center thereof. A charging unit 2, an exposing unit 3, a developing unit 4, a transfer unit 5A, a charge removing unit 5B, a separating pawl 5C, and a cleaning unit 6 are disposed around the photoconductive drum 1. A fixing unit 8 is provided on a downstream side of the charge removing unit 5B. Image forming processing is performed by the units in a procedure schematically explained below.

First, the charging unit 2 uniformly charges the surface of the photoconductive drum 1. On the other hand, an original document read by the reading section 11 is converted into image data and input to the exposing unit 3. The exposing unit 3 irradiates a laser beam corresponding to a level of the image data on the photoconductive drum 1 and forms an electrostatic latent image on the photoconductive drum 1. The electrostatic latent image is developed with a toner supplied from the developing unit 4. A toner image is formed on the photoconductive drum 1.

A sheet stored in a sheet storing section 7 (7A, 7B, and 7C) is conveyed to a transfer position (a space between the photoconductive drum 1 and the transfer unit 5A) passing through a paper-thickness detecting section 90 via several conveying rollers. In the transfer position, the transfer unit 5A transfers the toner image from the photoconductive drum 1 onto the sheet. The charge removing unit 5B removes charges on the surface of the sheet having the toner image transferred thereon. The separating pawl 5C separates the sheet from the photoconductive drum 1. Thereafter, the sheet is conveyed by an intermediate conveying section 5D and heated and pressed by the fixing unit 8. The toner image is fixed on the sheet. The sheet subjected to fixing processing is discharged from a discharging section 5E and output to the sheet finishing apparatus 20.

The cleaning unit 6 arranged downstream of the separating pawl 5C removes a developer remaining on the surface of the photoconductive drum 1 and prepares for the next image formation.

The sheet finishing apparatus 20 includes, besides a sorter section configured to sort sheets, a sheet folding apparatus 30 and a sheet-bundle placing section 40.

The sheet folding apparatus 30 performs folding such as processing for saddle-folding (double-folding) the center of a printed sheet discharged from the image forming section 12 and triple-folding such as so-called inward triple folding and Z-folding. In some case, the center of sheets is saddle-bound by a stapler before the sheets are saddle-folded and, thereafter, the sheets are saddle-folded and saddle-stapled. The sheets subjected to the folding and the saddle stapling by the sheet folding apparatus 30 are discharged to the sheet-bundle placing section 40 and stacked.

(2) Configuration of the Sheet Folding Apparatus

Figure 3:
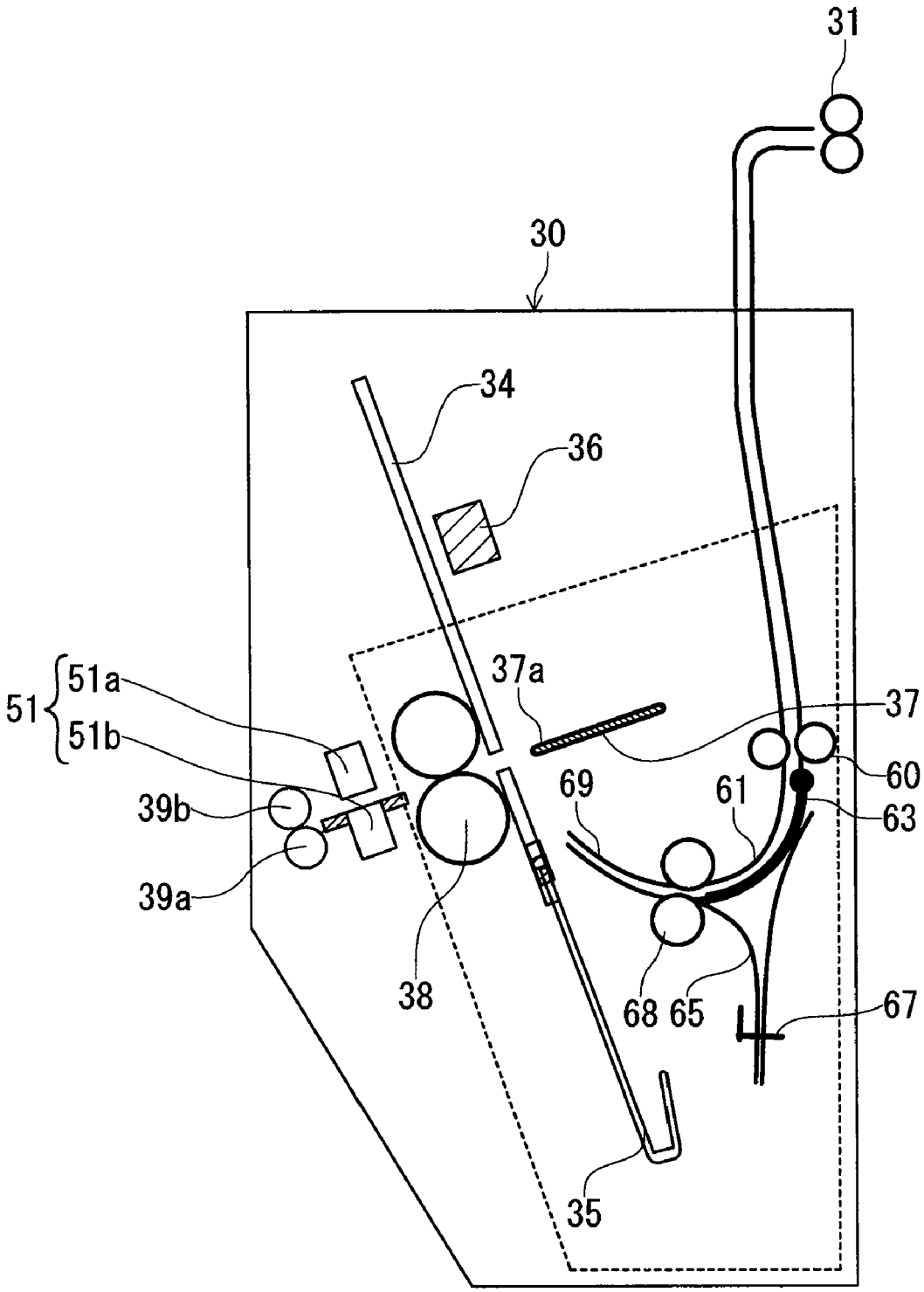
FIG. 3 is a sectional view of a configuration example of a sheet folding apparatus of the embodiment.

FIG. 3 is a sectional view of a configuration example of details of the sheet folding apparatus 30.

The sheet folding apparatus 30 receives, in an inlet roller pair 31, a sheet discharged from the discharging section 5E of the image forming section 12 and passes the sheet to the conveying roller pair 60.

Figure 4A:
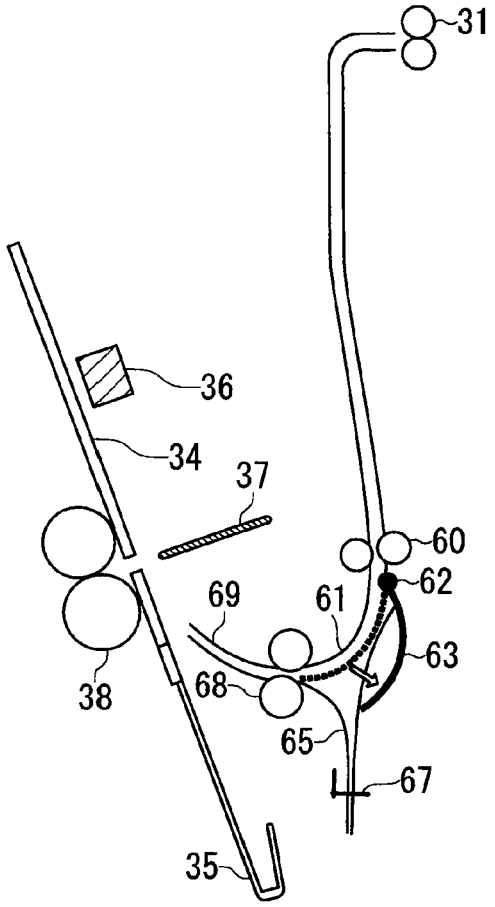
FIGS. 4A and 4B are diagrams of an operation concept of the sheet folding apparatus of the embodiment.
Figure 4B:
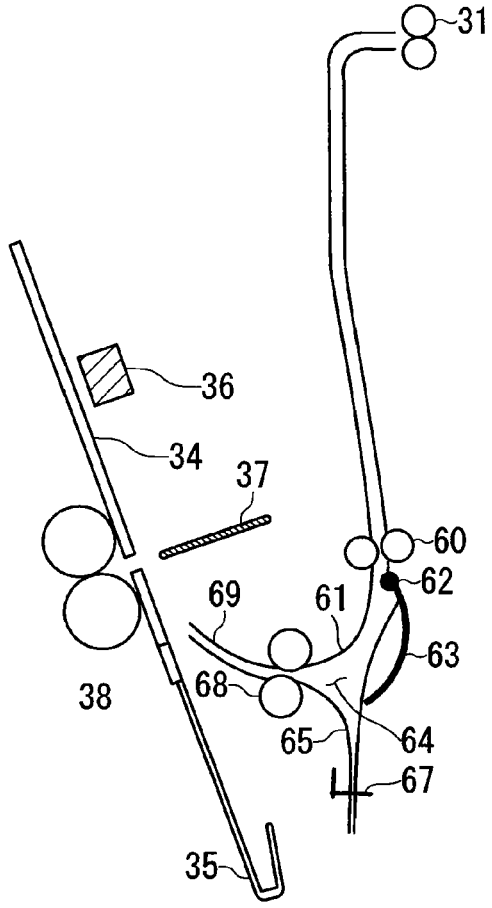

A conveying path 61 curved in a substantial J shape is provided on a downstream side of the conveying roller pair 60. As shown in FIG. 4A, the conveying path 61 includes a shutter 63 axially supported by a shaft 62 to be pivotable. When the shutter 63 is opened, as shown in FIG. 4B, an opening 64 is formed below the conveying path 61.

A retracting conveying path 65, an inlet of which is opened to the opening 64 and an outlet of which is closed by a stopper 67, is provided further below the opening 64. As explained later, the retracting conveying path 65 has a role of leading, if a sheet is tripled-folded, the front end of the sheet from the inlet to the stopper 67 and temporarily retracting a front portion of the sheet. A sectional shape of the inlet of the retracting conveying path 65 is widened in a funnel shape as shown in FIG. 4B. The back of the sheet is continued to be pushed by the conveying roller pair 60, while the sheet is led to the retracting conveying path 65 and the front end of the sheet bumps against the stopper 67. As a result, a bend of the sheet occurs near an inlet of the funnel shape. Since the retracting conveying path 65 is widened, it is possible to surely cause the bend of the sheet without being prevented by a sidewall of the retracting conveying path 65.

A first folding roller pair 68 is provided on the downstream side of the conveying path 61 near the inlet of the retracting conveying path 65. Arising conveying path 69 inclining upward is provided further downstream of the first folding roller pair 68.

The first folding roller pair 68 nips, if the sheet is tripled-folded, a bend caused by pushing the sheet led into the retracting conveying path 65 by the conveying roller pair 60 and forms a first fold. The first folding roller pair 68 delivers, with the first fold as the head, the sheet to the rising conveying path 69.

On the other hand, if the sheet is double-folded, the first folding roller pair 68 nips the front end of the sheet conveyed through the conveying path 61, the shutter 63 of which is closed, and directly delivers the sheet without a fold to the rising conveying path 69.

A standing tray 34 having an inclined placing surface is provided ahead of the rising conveying path 69. If the sheet is triple-folded, the sheet moves to an upper part of the inclination of the standing tray 34 with the first fold as the head. If the sheet is double-folded, the front end of the sheet on which a fold is not formed moves to the upper part of the inclination of the standing tray 34.

A stacker 35 stays on standby in a lower part of the standing tray 34. The stacker 35 receives the lower end of the sheet switched back and falling from the upper part of the inclination of the standing tray 34.

A stapler (a saddle stapling unit) 36 is disposed around the middle of the standing tray 34. If saddle stapling (stapling) is applied to plural sheets (a sheet bundle), the position of the stacker 35 is adjusted such that a position of the sheet bundle that should be stapled (the center in an up to down direction of the sheet bundle) faces the stapler 36.

After the sheet bundle is saddle-stapled by the stapler 36, the stacker 35 falls until a position of the sheet bundle that should be folded next (the position in the center of the up to down direction of the sheet bundle where a staple is driven) is set in the front of a folding blade 37.

When the position that should be folded is set in the front of the folding blade 37, a tip 37*a* of the folding blade 37 pushes in a surface that should be an inner surface after the sheet bundle is folded.

If the sheet bundle is only folded without being stapled, the position of the stacker 35 is adjusted such that the position that should be folded is set in the front of the folding blade 37. The sheet delivered from the rising conveying path 69 is placed on the stacker 35. A second folding roller pair 38 is provided ahead in a traveling direction of the folding blade 37. The sheet pushed in by the folding blade 37 is caught in a nip of the second folding roller pair 38 and a second fold is formed in the sheet.

In the case of triple folding, two folds, i.e., the first fold formed by the first folding roller pair 68 and the second fold formed by the second folding roller pair 38 are formed in the sheet. On the other hand, in the case of double folding, only the second fold formed by the second folding roller pair 38 is formed in the sheet.

The sheet having the second fold formed thereon by the second folding roller pair 38 is conveyed to a fold reinforcing unit 50 provided further on the downstream side of the second folding roller pair 38. The sheet conveyed to the fold reinforcing unit 50 temporarily stops being conveyed in the fold reinforcing unit 50.

The fold reinforcing unit 50 includes a fold reinforcing roller pair 51 (a pair of rollers including an upper roller 51*a* and a lower roller 51*b*). The fold reinforcing roller pair 51 moves in a direction orthogonal to a conveying direction of the sheet (a direction along a line of the fold) while pressing the fold and reinforces the fold.

The sheet having the fold reinforced by the fold reinforcing unit 50 starts being conveyed again. The sheet is drawn by a discharge roller pair 39*a* and 39*b* and output to the sheet-bundle placing section 40. The sheet subjected to the folding is placed on the sheet-bundle placing section 40.

It is possible to select whether fold reinforcing processing is carried out. If the fold reinforcing processing is not carried out, the sheet pushed out from the second folding roller pair 38 is directly drawn by the discharge roller pair 39*a* and 39*b* and output to the sheet-bundle placing section 40.

(3) Double Folding

Figures 5A, 5B, 5C:
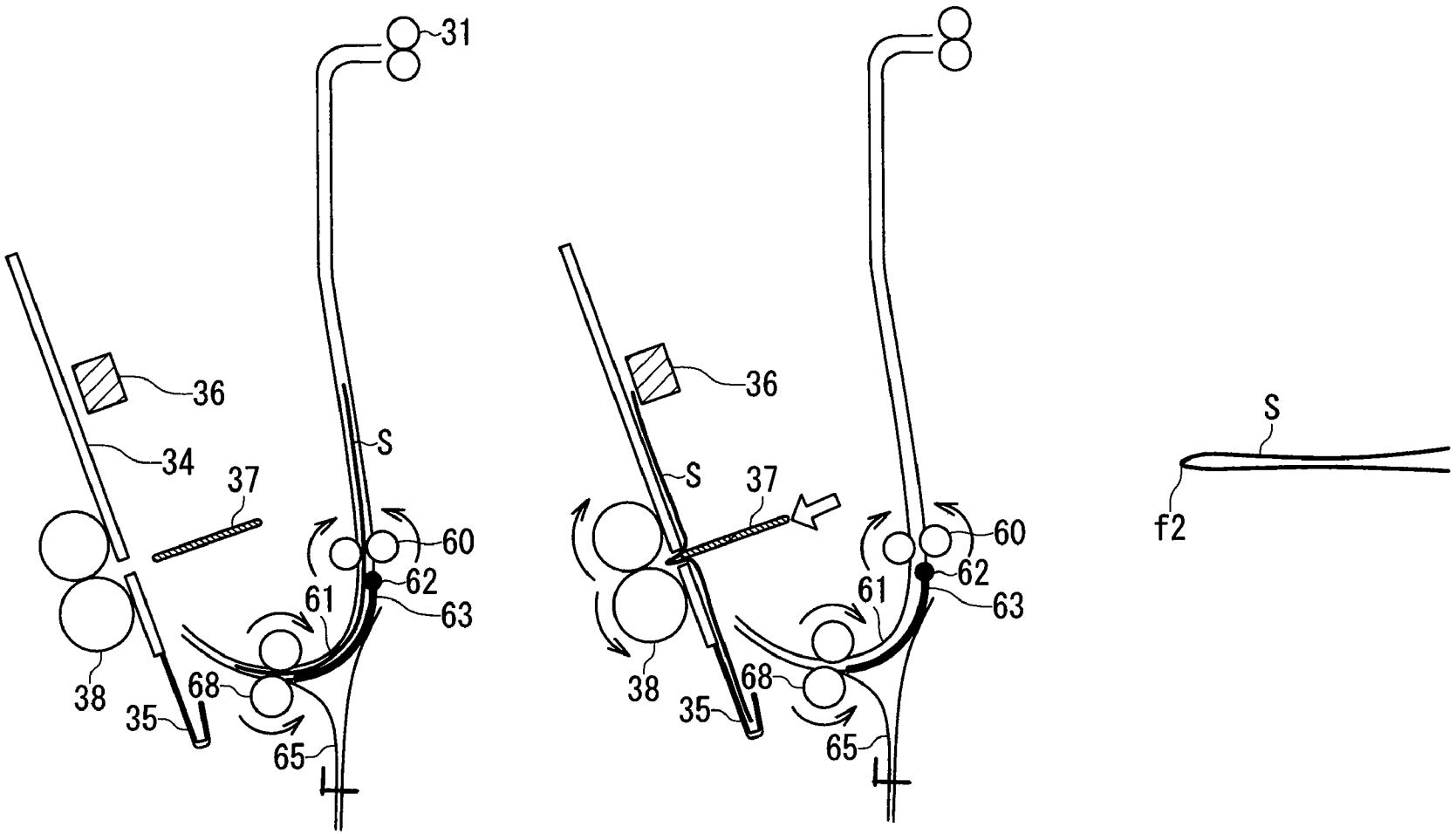
FIGS. 5A to 5C are diagrams for explaining operation for double-folding a sheet using the sheet folding apparatus of the embodiment.

FIGS. 5A and 5B are diagrams of an operation concept of the double folding by the sheet folding apparatus 30 according to this embodiment. FIG. 5C is a diagram of a double-folded sheet.

As explained above, if a sheet is double-folded, the shutter 63 of the conveying path 61 is closed. The shutter 63 is urged in the clockwise direction in FIGS. 5A and 5B around the shaft 62 by, for example, a not-shown spring and closes the opening 64 of the conveying path 61. Therefore, as shown in FIG. 5A, a sheet S is conveyed through the conveying path 61 by the conveying roller pair 60 and the first folding roller pair 68 without entering the retracting conveying path 65 and discharged to the standing tray 34. The rear end of the sheet is received by the stacker 35. Thereafter, the fold blade 37 moves in an arrow direction and pushes the sheet S into a nip of the second folding roller pair 38 passing through a slot provided on the standing tray 34. One fold (a second fold f2) is formed in the sheet S according to rotation of the second folding roller pair 38. As shown in FIG. 5C, the sheet S is double-folded.

As explained above, plural sheets may be saddle-folded by using the folding blade 37 and the second folding roller pair 38 after being bound and saddle-stapled by the stapler 36.

(4) Triple Folding

Figure 6A:
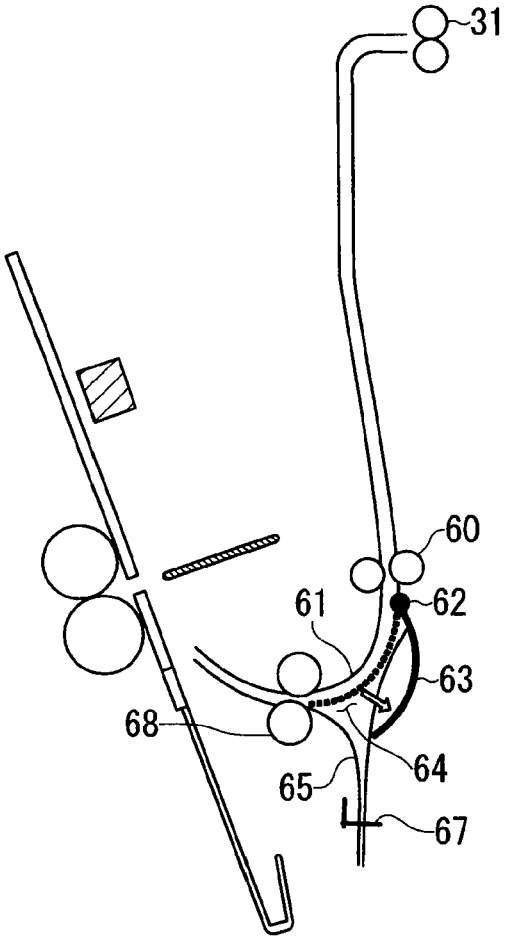
FIGS. 6A-6B, 7A-7B, and 8A-8C are diagrams for explaining operation for triple-folding a sheet using the sheet folding device of the embodiment.
Figure 6B:
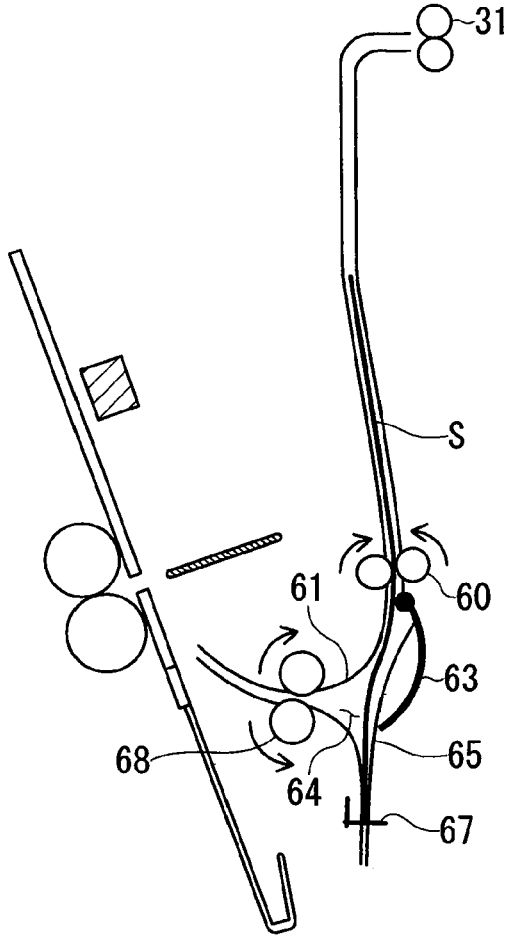
Figure 7A:
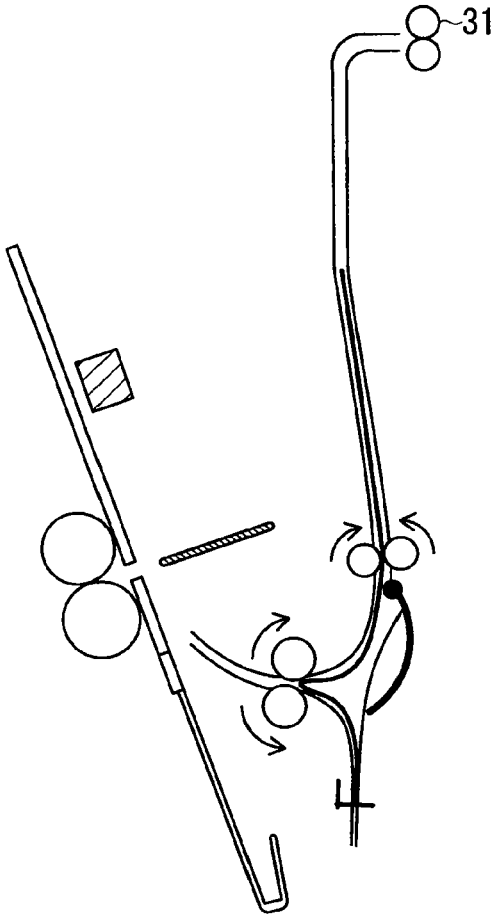
Figure 7B:
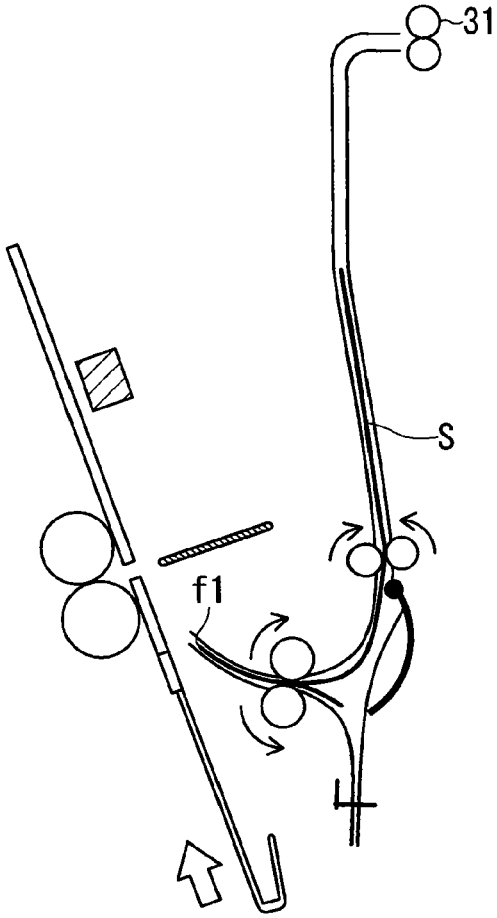
Figure 8A:
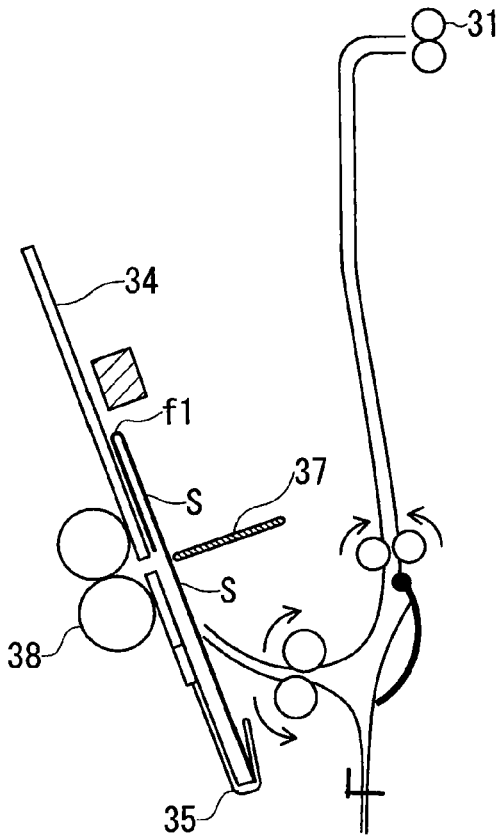
Figure 8B:
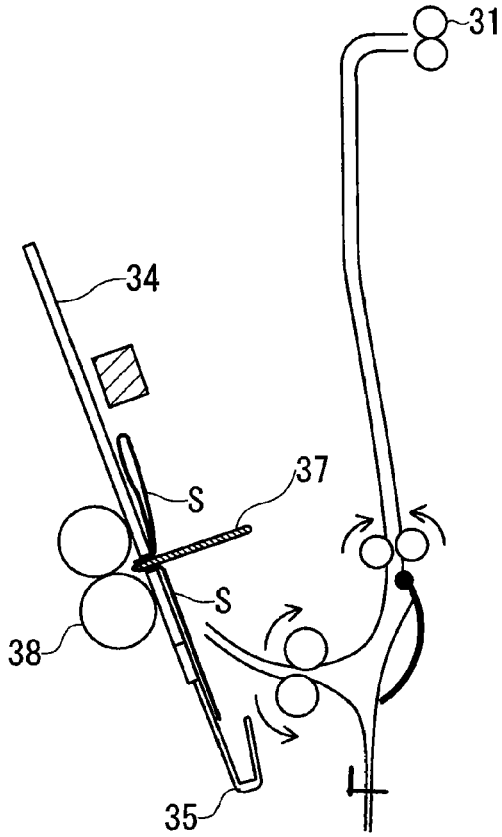
Figure 8C:
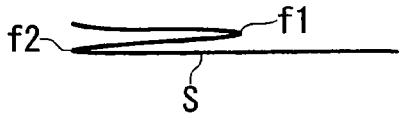

FIGS. 6A-6B, 7A-7B, and 8A-8C are diagrams of an operation concept of the triple folding by the sheet folding apparatus 30 according to this embodiment. FIG. 8C is a diagram of a triple-folded sheet.

If a sheet is triple-folded, first, as shown in FIG. 6A, the shutter 63 of the conveying path 61 is opened and the opening 64 is formed in the conveying path 61. The shutter 63 is rotated in the counterclockwise direction around the shaft 62 and opened by, for example, tensile force of a not-shown solenoid.

Meanwhile, the sheet S is conveyed by the inlet roller pair 31 and the conveying roller pair 60. The front portion of the sheet S is led to the retracting conveying path 65 through the opening 64. Since the outlet of the retracting conveying path 65 is closed by the stopper 67, the front end of the sheet S bumps against the stopper 67 as shown in FIG. 6B.

The conveying path 61 and the retracting conveying path 65 on the upstream side of the opening 64 are desirably arranged substantially in one straight line such that the sheet S is smoothly led from the conveying path 61 to the retracting conveying path 65.

Even after the front end of the sheet S bumps against the stopper 67, the conveying roller pair 60 continues rotating. Also, a portion near the inlet of the retracting conveying path 65 is formed in a shape widened in a funnel shape. As a result, as shown in FIG. 7A, a bend projecting toward a nip of the first folding roller pair 68 is caused near the inlet of the retracting conveying path 65. The head of the bend is soon nipped by the nip of the first folding roller pair 68. As shown in FIG. 7B, the first fold f1 is formed in the sheet S.

The position of the first fold f1 can be adjusted according to the position of the stopper 67. In an example shown in FIGS. 6A-6B, 7A-7B, and 8A-8C, the first fold f1 is formed in a position a quarter of a sheet size from the front end of the sheet S that bumps against the stopper 67.

The sheet S having the first fold f1 formed thereon is placed on the standing tray 34 as shown in FIG. 8A. Thereafter, the folding blade 37 is projected toward the second folding roller pair 38, as shown in FIG. 8B, whereby a second fold f2 is formed in the sheet S. The position of the second fold f2 can be adjusted according to the position of a pawl of the stacker 35. In the example shown in FIGS. 6A-6B, 7A-7B, and 8A-8C, the second fold f2 is formed in a position a half of a sheet size from the front end of the sheet S (the center of the sheet).

In this example, as shown in FIG. 8C, triple folding for partially forming a Z shape in the sheet S is performed. By applying the partial Z-folding to a sheet of the A3 size, it is possible to set a size after the folding to the A4 size and adjust sizes of mixed documents of the A3 size and the A4 size to the A4 size.

As explained above, in the sheet folding apparatus 30 according to this embodiment, most of the folding mechanisms are shared in the double folding and the triple folding. Specifically, the folding mechanisms such as the conveying roller pair 60, the first and second folding roller pairs 38 and 68, the conveying path 61, and the folding blade 37 are shared in the double folding and the triple folding. Only the shutter 63 and the retracting conveying path 65 are exclusively used in the triple folding.

Further, in the sheet folding apparatus 30 according to this embodiment, it is also possible to perform the saddle stapling using the same basic configuration.

In addition, in the sheet folding apparatus 30 according to this embodiment, it is possible to perform the various kinds of triple folding simply by changing the position of the stopper 67 of the retracting conveying path 65.

FIGS. 9A to 9D are diagrams for explaining that so-called inward triple folding and Z-folding in the same triple folding can be switched simply by changing the position of the stopper 67.

Figure 9A:
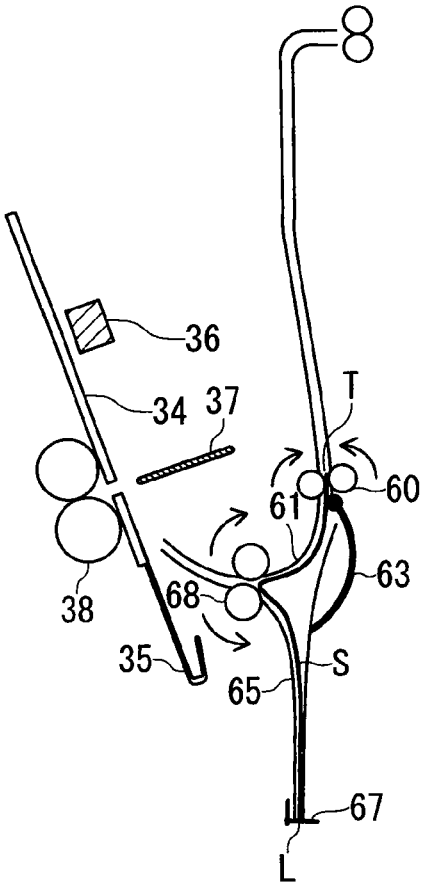
FIGS. 9A to 9D are diagrams for explaining operation for inward-triple-folding and Z-folding a sheet using the sheet folding apparatus of the embodiment.
Figure 9C:
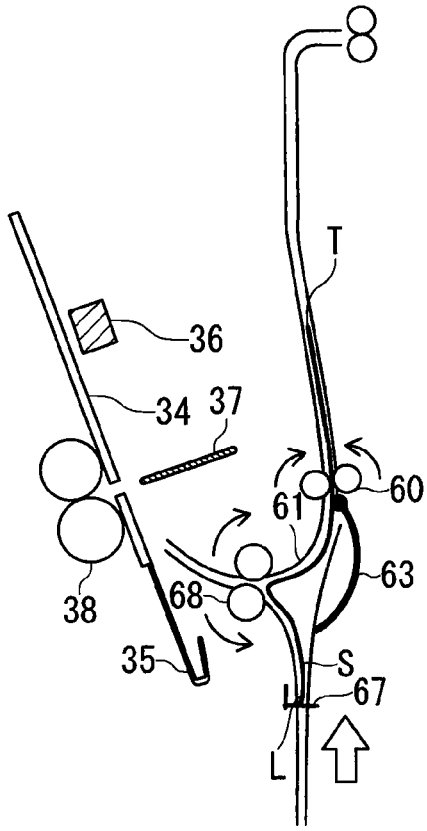
Figure 9B:
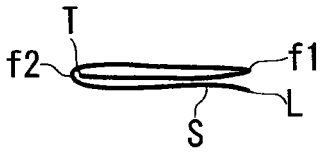

If the inward triple folding shown in FIG. 9B is performed, a bend is caused in a position two third of a sheet size from a front end L of the sheet S and the first fold f1 is formed in the position of the bend. The front end L of the sheet S having the first fold f1 formed thereon is received by the pawl of the stacker 35. The position of the pawl of the stacker 35 is adjusted such that the folding blade 37 is set in a position one third of the sheet size from the front end L of the sheet S. As a result, the second fold f2 is formed in the position one third of the sheet size from the front end L of the sheet S. Inward triple folding shown in FIG. 9B is completed.

Figure 9D:
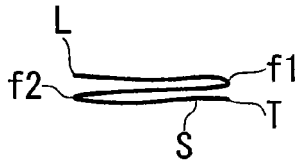

On the other hand, if the Z-folding shown in FIG. 9D is performed, the position of the stopper 67 is lifted higher than the position shown in FIG. 7A, a bend is caused in the position one third of the sheet size from the front end L of the sheet S, and the first fold f1 is formed in the position of the bend. In this case, rather than the front end L, a rear end T of the sheet S having the first fold f1 formed thereon is received by the pawl of the stacker 35. As in the case of the inward triple folding, the position of the pawl of the stacker 35 is adjusted such that the blade 37 is set in the position one third of the sheet size from the rear end T of the sheet S. As a result, the second fold f2 is formed in the position one third of the sheet size from the rear end T of the sheet S. The Z-folding shown in FIG. 9D is completed.

Even if a folding method is the same, it is necessary to change the position of a fold if a size of the sheet S is different. Even in such a case, it is possible to appropriately apply the double folding and the triple folding to sheets having different sizes by adjusting the position of the stopper 67 and the position of the pawl of the stacker 35 as appropriate according to a size of a sheet.

In the example explained above, one stopper 67 is moved up and down along the retracting conveying path 65 according to a size of a sheet and a position of a first fold (which changes according to a folding method).

Instead, it is also possible to adopt a method of selectably providing plural stoppers 67 respectively in plural fixed positions along the retracting conveying path 65 and selecting one stopper 67 out of the plural stoppers 67 according to at least one of a size of a sheet and a position of a first fold.

Figure 10A:
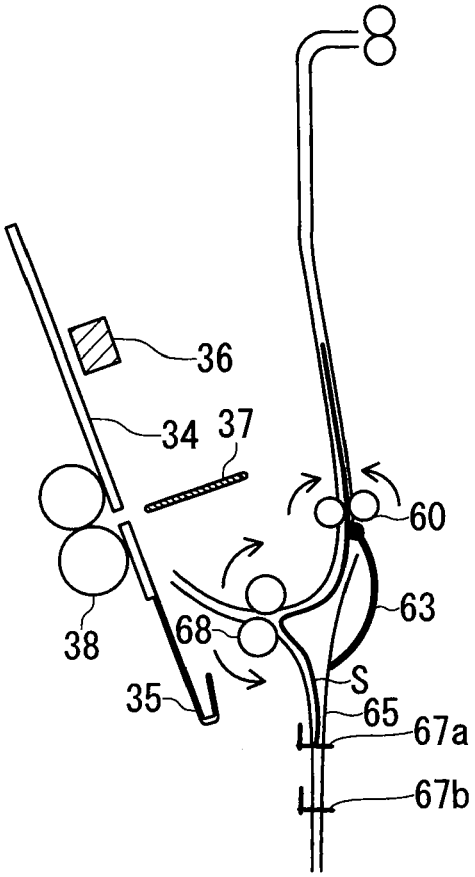
FIGS. 10A to 10D are diagrams for explaining operation for Z-folding sheets having different sizes (the A4 size and the A3 size) using the sheet folding apparatus of the embodiment.
Figure 10C:
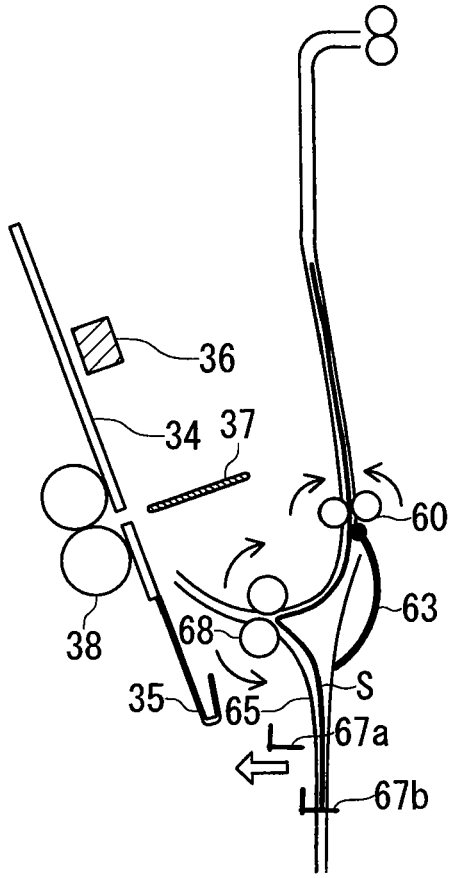
Figure 10B:
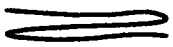
Figure 10D:
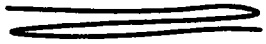

FIGS. 10A and 10C are diagrams of examples in which two stoppers 67*a* and 67*b* are disposed in different fixed positions in the retracting conveying path 65. Even if the same Z-folding is performed, the position of a first fold is different between a sheet of the A4 size and a sheet of the A3 size. FIGS. 10A and 10B are examples in which the sheet of the A4 size is z-folded. The front end of the sheet bumps against the stopper 67*a* present in a high position. On the other hand, if the sheet of the A3 size is Z-folded, as shown in FIG. 100, the stopper 67*a* is moved to a position where the stopper 67*a* does not close the retracting conveying path 65. The front end of the sheet bumps against the stopper 67*b* present in a lower position. When types of sheet sizes are limited to some extent, it is less necessary to continuously move the stopper 67 in the up to down direction. A method of selecting one stopper out of plural stoppers disposed in discrete plural positions as shown in FIGS. 10A to 10D is also effective. A driving method for the stoppers can be simplified.

As explained above, with the sheet folding apparatus 30, the sheet finishing apparatus 20, and the sheet folding method according to this embodiment, compared with the folding apparatus in the past, it is possible to perform various kinds of double folding and triple folding with a simpler and more compact configuration.

While certain embodiments have been described, these embodiments have been presented by way of example only, and are not intended to limit the scope of the invention. Indeed, the novel apparatuses and units described herein may be embodied in a variety of other forms; furthermore, various omissions, substitutions and changes in the form of the apparatuses and units described herein may be made without departing from the spirit of the invention. The accompanying claims and their equivalents are intended to cover such forms or modifications as would fall within the scope and spirit of the invention.

What is claimed is:

1. A sheet folding apparatus comprising:

a conveying roller pair configured to convey a sheet;

a conveying path provided on a downstream side of the conveying roller pair, an opening being formed in a part of the conveying path if the sheet is triple-folded and being closed if the sheet is double-folded;

a retracting conveying path, an inlet of which is opened to the opening of the conveying path and an outlet of which is closed by a stopper, the retracting conveying path leading a front end of the sheet, which is conveyed through the conveying path, from the inlet to the stopper and temporarily retracting a front of the sheet if the sheet is triple-folded;

a first folding roller pair disposed near the inlet of the retracting conveying path, the first folding roller pair nipping, if the sheet is triple-folded, a bend caused by pushing of the sheet led by the conveying rollers into the retracting conveying path to form a first fold and nipping, if the sheet is double-folded, the front end of the sheet, which is conveyed through the closed conveying path, and conveying the sheet further downstream; and a second folding roller pair configured to further form a second fold in the sheet on which the first fold is formed to triple-fold the sheet, and form only the second fold in the sheet on which the first fold is not formed to double-fold the sheet.

2. The apparatus according to claim 1, wherein a position of the stopper is changed according to at least one of a size of the sheet and a position of the first fold.

3. The apparatus according to claim 1, wherein a plurality of the stoppers are selectably provided respectively in plural fixed positions along the retracting conveying path, one stopper selected according to at least one of a size of the sheet and a position of the first fold closes the outlet of the retracting conveying path, and the other stoppers move to a standby position where the other stoppers do not close the retracting conveying path.

4. The apparatus according to claim 1, wherein, in the retracting conveying path, a section of the inlet is formed in a shape widened in a funnel shape so as not to prevent occurrence of the bend.

5. The apparatus according to claim 1, wherein the conveying path reaching from the conveying rollers to the first folding roller pair is formed to be curved and, while the conveying path and the retracting conveying path on an upstream side of the opening are arranged substantially in one straight line.

6. The apparatus according to claim 1, wherein the conveying path includes:

a shutter plate axially supported rotatably at an upstream end of the opening; and a driving mechanism configured to open the shutter plate such that the opening is formed in the conveying path if the sheet is triple-folded, and to pivot the shutter plate to close the opening if the sheet is double-folded.

7. The apparatus according to claim 1, further comprising:

an inclined tray on which the sheet pushed out from the first folding roller pair is stacked and a slot is formed in a position corresponding to a position of the second fold; and a folding blade configured to push the sheet stacked on the inclined tray into a nip of the second folding roller pair through the slot.

8. A sheet finishing apparatus comprising:

a conveying roller pair configured to convey a sheet;

a conveying path provided on a downstream side of the conveying roller pair, an opening being formed in a part of the conveying path if the sheet is triple-folded and being closed if the sheet is double-folded;

a retracting conveying path, an inlet of which is opened to the opening of the conveying path and an outlet of which is closed by a stopper, the retracting conveying path leading a front end of the sheet, which is conveyed through the conveying path, from the inlet to the stopper and temporarily retracting a front of the sheet if the sheet is triple-folded;

a first folding roller pair disposed near the inlet of the retracting conveying path, the first folding roller pair nipping, if the sheet is triple-folded, a bend caused by pushing of the sheet led by the conveying rollers into the retracting conveying path to form a first fold and nipping, if the sheet is double-folded, the front end of the sheet, which is conveyed through the closed conveying path, and conveying the sheet further downstream;

a second folding roller pair configured to further form a second fold in the sheet on which the first fold is formed to triple-fold the sheet, and to form only the second fold in the sheet on which the first fold is not formed to double-fold the sheet;

an inclined tray on which the sheet pushed out from the first folding roller pair is stacked and a slot is formed in a position corresponding to a position of the second fold;

a folding blade configured to push the sheet stacked on the inclined tray into a nip of the second folding roller pair through the slot; and a sheet placing section on which a sheet subjected to folding is stacked.

9. The apparatus according to claim 8, wherein a position of the stopper is changed according to at least one of a size of the sheet and a position of the first fold.

10. The apparatus according to claim 8, wherein a plurality of the stoppers are selectably provided respectively in plural fixed positions along the retracting conveying path, one stopper selected according to at least one of a size of the sheet and a position of the first fold closes the outlet of the retracting conveying path, and the other stoppers move to a standby position where the other stoppers do not close the retracting conveying path.

11. The apparatus according to claim 8, wherein, in the retracting conveying path, a section of the inlet is formed in a shape widened in a funnel shape so as not to prevent occurrence of the bend.

12. The apparatus according to claim 8, wherein the conveying path reaching from the conveying rollers to the first folding roller pair is formed to be curved, while the conveying path and the retracting conveying path on an upstream side of the opening are arranged substantially in one straight line.

13. The apparatus according to claim 8, wherein the conveying path includes:

a shutter plate axially supported rotatably at an upstream end of the opening; and a driving mechanism configured to open the shutter plate such that the opening is formed in the conveying path if the sheet is triple-folded and, to pivot the shutter plate to close the opening if the sheet is double-folded.

14. A sheet folding method comprising:

conveying, with conveying rollers, a sheet to a conveying path in which an opening formed in a part of the conveying path is opened if the sheet is triple-folded and is closed if the sheet is double-folded;

causing, if the sheet is triple-folded, a retracting conveying path, an inlet of which is opened to the opening of the conveying path and an outlet of which is closed by a stopper, to lead a front end of the sheet, which is conveyed through the conveying path, from the inlet to the stopper and temporarily retract a front of the sheet;

nipping, if the sheet is triple-folded, with a first folding roller pair disposed near the inlet of the retracting conveying path, a bend caused by pushing of the sheet led by the conveying rollers into the retracting conveying path to form a first fold and nipping, if the sheet is double-folded, the front end of the sheet, which is conveyed through the closed conveying path, and conveying the sheet further downstream; and further forming, with a second folding roller pair, a second fold in the sheet on which the first fold is formed to triple-fold the sheet, and forming only the second fold in the sheet on which the first fold is not formed to double-fold the sheet.

15. The method according to claim 14, wherein a position of the stopper is changed according to at least one of a size of the sheet and a position of the first fold.

16. The method according to claim 14, wherein a plurality of the stoppers are selectably provided respectively in plural fixed positions along the retracting conveying path, one stopper selected according to at least one of a size of the sheet and a position of the first fold closes the outlet of the retracting conveying path, and the other stoppers move to a standby position where the other stoppers do not close the retracting conveying path.

17. The method according to claim 14, wherein, in the retracting conveying path, a section of the inlet is formed in a shape widened in a funnel shape so as not to prevent occurrence of the bend.

18. The method according to claim 14, wherein the conveying path reaching from the conveying rollers to the first folding roller pair is formed to be curved, while the conveying path and the retracting conveying path on an upstream side of the opening are arranged substantially in one straight line.

19. The method according to claim 14, wherein the conveying path includes a shutter plate axially supported rotatably at an upstream end of the opening, and the method further comprises opening the shutter plate such that the opening is formed in the conveying path if the sheet is triple-folded, and pivoting the shutter plate to close the opening if the sheet is double-folded.

20. The method according to claim 14, further comprising:

stacking the sheet pushed out from the first folding roller pair on an inclined tray on which a slot is formed in a position corresponding to a position of the second fold; and pushing, with a folding blade, the sheet stacked on the inclined tray into a nip of the second folding roller pair through the slot.

* * * * *